United States Patent [19]

Hirano et al.

[11] 4,252,561

[45] Feb. 24, 1981

[54] CHROMIUM-ALLOYED STEEL WHICH IS CORROSION RESISTANT TO CAUSTIC ALKALINE SOLUTION

[75] Inventors: Tadao Hirano; Toshio Morimura, both of Chichibu; Ryoichi Yoshimura, Yokohama, all of Japan

[73] Assignee: Showa Denko Kabushiki Kaisha, Tokyo, Japan

[21] Appl. No.: 23,942

[22] Filed: Mar. 26, 1979

Related U.S. Application Data

[63] Continuation of Ser. No. 833,901, Sep. 16, 1977, abandoned.

[30] Foreign Application Priority Data

Sep. 21, 1976 [JP] Japan ..... 51-1132707

[51] Int. Cl.[3] ..... C22C 39/14; C22C 37/10

[52] U.S. Cl. ..... 75/126 C; 75/126 F; 75/126 G; 75/128 R

[58] Field of Search ..... 75/126 R, 128 R, 126 C, 75/126 F, 126 G

[56] References Cited

U.S. PATENT DOCUMENTS

| | | | |
|---|---|---|---|
| 3,723,101 | 3/1973 | Hunt | 75/126 R |
| 3,778,255 | 12/1973 | Ototani et al. | 75/126 C |
| 3,807,994 | 4/1974 | Gregory et al. | 75/126 F |
| 3,852,063 | 12/1974 | Nimmi et al. | 75/124 |

*Primary Examiner*—L. Dewayne Rutledge

*Assistant Examiner*—Upendra Roy

*Attorney, Agent, or Firm*—Armstrong, Nikaido, Marmelstein & Kubovcik

[57] ABSTRACT

One of the difficulties in developing a metallic material which is corrosion resistant to caustic alkaline solutions is that the corrosiveness of these solutions is different depending upon the process for producing the same. The chromium alloyed steel developed according to the present invention, contains, from 29 to 31%, of Cr; not more than 3% of Mo; not more than 0.005% of C; at least one element selected from the group of Nb and Ta in an amount, which follows the equation $$20\times C(\%)\leqq Nb(\%)+0.5\times Ta(\%)\leqq 60\times C(\%);$$

from 0.0005 to 0.02% of Ca and; not more than 0.02% of deoxidation products being present in said chromium alloyed steel and essentially composed of CaO, $SiO_2$ and $Al_2O_3$.

Because of the combination of the reduction of C, N and the impurities of the steel with the addition of Nb and/or Ta, the corrosion resistance of the chromium steel is excellent with regard to the caustic alkaline solution produced by every kind of processes. This excellent corrosion resistance is not essentially degraded by the welding of the chromium steel pieces and, further, the ductility and workability of the chromium steel are improved.

4 Claims, 2 Drawing Figures

CHROMIUM-ALLOYED STEEL WHICH IS CORROSION RESISTANT TO CAUSTIC ALKALINE SOLUTION

Figure 1:
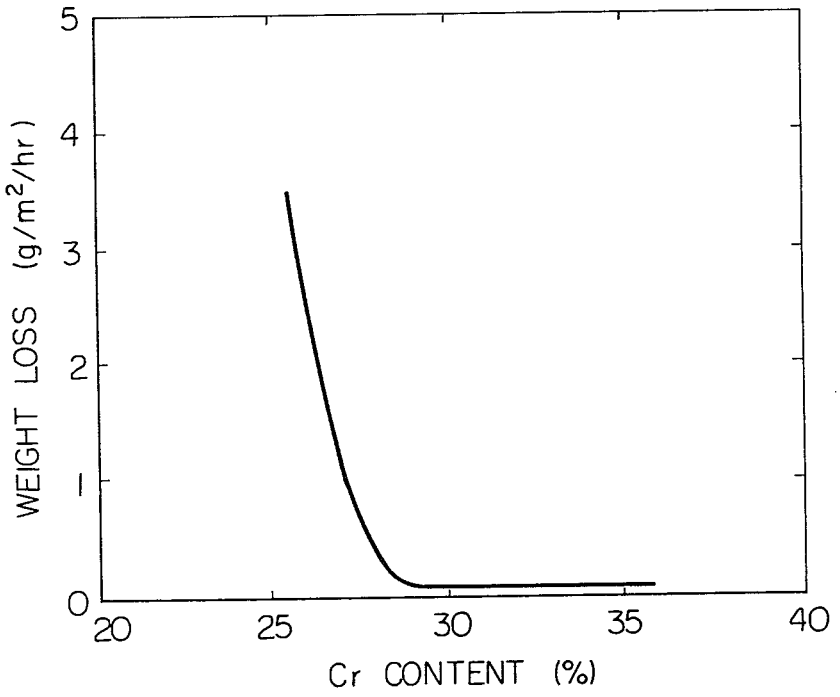

This is a continuation of application Ser. No. 833,901, filed Sept. 16, 1977, now abandoned.

The present invention relates to a metallic material, particularly a chromium steel which is corrosion resistant to a caustic alkaline solution and, more particularly, to a chromium steel which is used in an apparatus for handling a caustic alkaline solution so as to vaporize, condensate, refine, transfer, and store, etc., the same. The present invention even more particularly relates to a chromium steel which is used in an apparatus in a chemical plant for handling a caustic alkali solution produced by such methods as the mercury process, the diaphragm process and the ion exchange process and the like.

Metallic materials for the use in an apparatus in a chemical plant as mentioned above have previously been developed, in most instances, under the condition that each type of the metallic materials is limited to use in an apparatus used for only one of the mercury electrolytic, diaphragm electrolytic and ion exchange film processes. The reasons for limiting the use of the metallic materials are that the kinds and concentrations of impurities contained in the fluid of the processes for production of the caustic alkaline solution are different, from one process to another. The kinds and concentrations of the impurities can also change for various reasons, such as, for example, a change in the process for the production of the caustic alkaline solution. The phase "process for the production of the caustic alkaline solution" is, hereinafter, shortened to "process". Since the fluid of the process after a change in the kinds and concentrations of the impurities can become considerably more corrosive than before the change, the corrosion resistant metallic material which has been developed for one particular process, can no longer be used for another process, because of problems caused in the production process due to the corrosion of the metallic material in the apparatus being used for the process.

In Japan the process is now being converted from the mercury electrolytic process to either the diaphragm electrolytic process or the ion exchange film process. This basic reason for this conversion is the particular pollution problems involved in the mercury electrolytic process. However, the mercury electrolytic process is still not completely converted to the diaphragm electrolytic process or the ion exchange film process. Since the caustic alkalis produced by the diaphragm electrolytic process contain a greater amount of such impurities as alkali chlorates and alkali chlorides than those produced by the mercury electrolytic process, the corrosion behaviour of the metallic material in the apparatus used for the former process is considerably different from that of the metallic material in the apparatus used for the latter process. It is, therefore, necessary to select the metallic material used in the apparatus of the diaphragm electrolytic process, based on different criteria from that for the mercury electrolytic process. Since the kind of metallic material selected for the former process is different from that for the latter process, it is obvious that it would be difficult, if not impossible, to find a metallic material which is corrosion resistant in both processes.

The following facts are known regarding the caustic alkali produced by the respective process.

Firstly, the caustic alkali produced by the mercury electrolytic process exhibits higher purity compared with that produced by the other processes and, thus, contains a smaller amount of impurities.

Secondly, the caustic alkali produced by the diaphragm electrolytic process contains impurities in a concentration depending upon the kinds of the diaphragm material. When the diaphragm consists of asbestos, the alkali chlorates and alkali chlorides are contained, as impurities, in concentrations up to 0.5% and 15%, respectively, of the caustic alkaline solution. However, the concentration of the alkali chlorates can be reduced to a trace, which is close to the concentration of the same contained in the caustic alkali produced by the mercury electrolytic process.

Thirdly, the caustic alkali produced by the ion-exchange film process can have a concentration of impurities which is reduced to a trace according to one of the recently developed processes.

It is known to use a nickel, its alloy, an austenitic nickel-chromium steel and a ferritic chromium steel in the apparatus for handling the caustic alkalis.

The corrosion resistant characteristics of these metallic materials can be summarized as shown in Table 1, below.

TABLE 1

| Kind of process | Material: Ni and its alloy Austenitic stainless steel | Material: Ferritic stainless steel |
|---|---|---|
| Mercury Electrolytic Process (almost free from $ClO_3^-$) | Good | Poor |
| Diaphragm Electrolytic Process $ClO_3^-$ and $Cl^-$ are present) | Poor | Good |
| Ion Exchange Film Process (small $ClO_3^-$) | Intermediate | Poor |

In order to improve the poor corrosion resistance, illustrated in Table 1 above, the following metals or alloys are used or proposed for use in the apparatus for the handling of a caustic alkaline solution.

It is known that nickel or a nickel based alloy exhibit an excellent corrosion resistance to the caustic alkaline solution. Nickel or a nickel based alloy has been actually used in chemical plants for handling a caustic alkaline solution. However, since nickel or a nickel based alloy is very expensive, the relatively cheap, austenitic nickel-chromium steel is used instead of a part of the nickel or the nickel based alloy. Even the nickel or the nickel based alloy does not necessarily exhibit a sufficiently high corrosion resistance for the handling of the caustic alkaline solution which is produced by the diaphragm electrolytic process.

With regard to the chromium steel referred to as ferritic stainless steel, the so-called, high chromium ferritic stainless steel is proposed in the Japanese Laid Open Patent Applications Nos. 50-71508; 51-11097; 50-85598.

In the Japanese Laid Open Patent Application No. 50-71508, alloyed steel having the following composition is proposed for apparatus intended for use in the diaphragm electrolytic production process of a caustic alkaline solution.

From 23 to 35% of Cr.

Not more than 0.08% of C.

Not more than 0.08% of N.

Not more than 1.2% of Ti and/or Nb.

According to a statement in this Laid Open Specification, a steel containing 30% or more of steel exhibits an extremely excellent corrosion resistance, no matter whether the alkali chlorates, for example $NaClO_3$, are present in the caustic alkaline solution or not. This statement involves the recognition that the corrosion resistance is poor when the Cr content of the alloyed steel is less than 30%. In fact, it is stated in this specification that the corrosion resistance at a Cr content less than 30% is deteriorated when the alkali chlorates are present in a small amount, specifically when they are not present in the caustic alkaline solution. Contrary to the good corrosion resistance at the high Cr-content, however, the mechanical properties of such alloyed steel is poor.

In the Japanese Laid Open Patent Application No. 51-11097, it is proposed to add Ni to the alloyed steel previously proposed in the Japanese Laid Open Patent Application No. 50-71508. The alloyed steel proposed in Application No. 51-11097 has the composition:

from 23 to 31% of Cr;

not less than 0.5% of Ni, but not more than the percentage determined by $1.5\times Cr(\%)-32$;

not more than 0.08% of C;

not more than 0.08% of N, and;

not more than 1.2% of Ti and/or Nb.

In order to improve the ductility of the previously proposed, high-Cr alloyed steel, Ni is added in this now proposed alloy, in such a manner that with an increase in the Cr-content within the specified range, the amount of addition of Ni is increased according to the specified equation. According to a statement in this specification, however, the corrosion resistance tends to be reduced by the addition of Ni. In addition, the disadvantageous relationship between the corrosion resistance and the absence of the alkali chlorates, mentioned in the Laid Open Application No. 50-71508, is not altered in the alloyed steel proposed by the Laid Open Application No. 51-11097.

In the Japanese Laid Open Patent Application No. 50-85598, there is a proposal for a material which is corrosion resistant to a solution containing an alkali-metal hydroxide (NaOH) and an alkali-metal chloride. This alloyed steel has the composition:

from 25.0 to 27.5% of Cr;

from 0.75 to 1.50% of Mo;

up to 0.01% of C;

up to 0.05% of N;

up to 0.04% of Mn;

up to 0.02% of P;

up to 0.02% of S;

up to 0.40% of Si;

up to 0.20% of Cu, and;

up to 0.50% of both Cu and Ni.

This alloyed steel is known under the name of "E-Brite 26-1" (which is name of the article produced by Airco Company). It cannot be said that this alloyed steel exhibits excellent corrosion resistance to both caustic alkaline solutions with and without the alkali chlorates. This is because the Cr content of from 25.0 to 27.5% is lower than 30% of Cr, which is required for the excellent corrosion resistance. In addition, the ductility of this alloyed steel is not very good.

As stated above, one of the difficulties in developing a chromium-alloyed steel which is corrosion resistant to caustic alkaline solutions is that the corrosiveness of these solutions is different depending upon the process for producing the same. Another of the difficulties in developing the chromium alloyed steel is that the other properties of this steel than the corrosion resistance must not be sacrified by the improvement of the corrosion resistance. The corrosion resistant chromium steel used for producing the apparatuses, in which the caustic alkaline solutions are handled, should not only be so excellently corrosion resistant that it can cope with the varying corrosiveness of the caustic alkaline solution, but should also be provided with both workability suitable for producing the apparatuses in which the caustic alkaline solution is handled, and ductility. Specifically, the corrosion resistant chromium steel must withstand an impact and external force, which are exerted on the apparatuses mentioned above, during the operation of the same. In addition, none the properties of the corrosion resistant chromium steel must be degraded by welding, because the apparatuses in which the caustic alkaline solutions are handled are frequently manufactured by welding together pieces of the corrosion resistant chromium steel.

It is an object of the present invention to provide a chromium steel which is excellent in corrosion resistant to any one of the caustic alkaline solution produced by the mercury electrolytic process, the diaphragm electrolytic process and the ion exchange film process.

It is another object of the present invention to provide a chromium steel which possesses both a good workability for producing an apparatus in which the caustic alkaline solution is handled, and a good ductility during the employment of these apparatuses, and; further, a chromium steel with corrosion resistance, workability and ductility properties which are not deteriorated by welding.

It is still another object of the present invention to provide a chromium steel which is well suited for use in a vaporization kettle for caustic alkaline solutions.

It is a further object of the present invention to improve the properties, particularly both the toughness and corrosion resistance of a welded apparatus constructed of the corrosion resistant chromium steel for handling and producing a caustic alkaline solution.

In accordance with the objects of the present invention, there is provided a chromium alloyed steel, which is corrosion resistant to a caustic alkaline solution and which comprises all by weight percent:

from 29 to 31%, of Cr;

not more than 3%, preferably 2.5% of Mo;

not more than 0.005% of C;

at least one element selected from the group of Nb and ta in an amount, which follows the equation $$20\times C(\%)\leqq Nb(\%)+0.5\times Ta(\%)\leqq 60\times C(\%);$$

not more than 0.015% of N;

not more than 0.008% of O;

not more than 0.020% of S;

not more than 0.025% of the sum of S and O;

from 0.0005 to 0.02% of Ca, and;

not more than 0.02% of deoxidation products being present in said chromium alloyed steel and essentially composed of:

from 3 to 20% of CaO;

from 5 to 80% of $Al_2O_3$, and;

from 5 to 80% of $SiO_2$.

The main inventive features of the above mentioned compositions are as follows.

A. Calcium (Ca) is present in the chromium alloyed steel. This means that the ferritic chromium steel is treated with Ca so as to decarburize, deoxidize and desufurize the steel. A part of the Ca remains in the chromium alloyed steel as metallic calcium. Another part of the Ca is present in the steel in the form of CaO. Due to the reduction of impurities by the treatment with Ca, the corrosion resistance and the ductility of the chromium-alloyed steel is improved. Since the impurities are reduced and the components of the nonmetallic inclusions are modified to contain the CaO nonmetallic inclusion, improvements are achieved with regard to the ductility and specifically to the workability of the chromium steel. It is preferable to add Ca into the steel within a vacuum furnace, a vacuum-degassing apparatus or a furnace having an argon atmosphere.

B. The both C and N are reduced to extremely low levels, while Nb and Ta are added, alone or in combination, into the chromium steel according to the present invention. Because of the reduction in the content of C and the addition of Nb and/or Ta, the formation of chromium carbides is suppressed, and instead, the carbides of Nb and/or Ta are formed in this chromium steel. Usually, chromium carbides formed during slow cooling of the chromium steel bring about the reduction of both the impact properties and corrosion resistance of every chromium steel, however, it is possible to prevent this reduction according to the present invention. The welded structures, which are produced with the chromium steel according to the present invention and which are slowly cooled after the welding, exhibit as excellent a ductility and corrosion resistance as before the welding. Because of the addition of Nb and/or Ta, the nitrogen, which is harmful to ductility and corrosion resistance, is fixed or stabilized by the Nb and/or Ta as nitrides of the same.

C. Cr is contained in the chromium steel according to the present invention in an amount of from 29 to 31%, with the result being that the required corrosion resistance of the chromium steel to the caustic alkaline produced by every processes is remarkably improved.

Because of the combination of the inventive features A, B and C, above, particularly the combination of the reduction of C, N and the impurities with the addition of Nb and/or Ta, the corrosion resistance of the chromium steel is excellent with regard to the caustic alkaline solution produced by every kind of processes. This excellent corrosion resistance is not essentially degraded by the welding of the chromium steel pieces and, further, the ductility and workability of the chromium steel are improved.

In accordance with said further object, mentioned above, there is provided a non-heat treated welded apparatus comprising a plurality of individual parts, a weld between said parts and joining them together, said individual parts and each of said welds being brought into contact with a caustic alkaline solution, wherein the process for producing said caustic alkaline solution is changed from one to another of the mercury electrolytic process, the diaphragm electrolytic process and the ion exchange film process, and said individual parts are composed of a chromium alloyed steel, which is corrosion resistant to a caustic alkaline solution and which comprises all by weight percent:

from 29 to 31% of Cr;

not more than 3%, preferably 2.5% of Mo;

not more than 0.005% of C;

at least one element selected from the group of Nb and Ta in an amount, which follows the equation:

$$20\times C(\%)\leqq Nb(\%)+0.5\times Ta(\%)\leqq 60\times C(\%);$$

not more than 0.015% of N;

not more than 0.008% of O;

not more than 0.029% of S;

not more than 0.025% of the sum of S and O;

from 0.0005 to 0.02% of Ca, and;

not more than 0.02% of deoxidatior products being present in said chromium alloyed steel and essentially composed of:

from 3 to 20% of CaO;

from 5 to 80% of $Al_2O_3$, and;

from 5 to 80% of $SiO_2$.

The welded apparatus mentioned above, for handling the caustic alkaline solution is also suited for handling therein a caustic alkaline solution which is produced by one of the mercury electrolytic process and the ion exchange film process. Examples of the welded construction mentioned above include the apparatuses used for producing the caustic alkaline solution and the apparatuses for handling the produced caustic alkaline solution. The former apparatuses are, for example, the vaporization, condensation, or refinement apparatuses as well as pipes, which connect these apparatuses. The latter apparatuses are, for example, the transferring- or storing apparatuses.

The parts of the welded construction for producing and handling the caustic alkaline solution are slowly cooled and are not heat-treated after being welded. In a case where the welded parts are subjected to an external impact force during the operation of the apparatuses for handling the caustic alkaline solution, one of the inventive features of the chromium steel according to the present invention, i.e. high ductility, will advantageously contribute to the stable operation of the apparatuses.

The chromium alloyed steel of the present invention is very effective by corrosion resistant to a concentrated caustic alkaline solution at elevated temperature, no matter whether this solution containes alkali chlorates or not. Such solution already produced by the process for producing the same can be handled, for example, in the vaporization and condensation apparatus.

The reasons for limiting the range of the components which are contained in the chromium alloyed steel are as follows.

A. Chromium Content of from 29 to 31%.

Chromium is one of the most effective elements for increasing the corrosion resistance of steel to corrosive media which include the caustic alkaline solution. The Cr content should not be less than 29% in the present invention. This content is required for the excellent corrosion resistance to caustic alkaline solutions having various concentrations of alkali chlorates, for example, a small amount, a trace amount, and even essentially zero. A film, which is in a thermodynamically stable state, is formed on the chromium steel which contains 29% or more of Cr, while this steel is immersed in a boiled caustic soda solution having a concentration of, for example 50%. However, when the Cr content is less than 29%, the film formed on the chromium steel is thermodynamically unstable. In a addition, with an increase in the Cr content, the chromium steel is likely to become brittle due to, for example, the precipitation of the $\sigma$-phase therein, and the workability of this steel is considerably degraded in accordance with the extent of the brittleness. The maximum amount of Cr should, therefore be 31%.

B. Molybdenum of not more than 3%.

A minor but effective amount of molybdenum must be added into the chromium steel to increase the corrosion resistance to the major component of the caustic alkaline solution, i.e. the caustic alkali itself. However, the Mo added in an amount of more than 3% promotes the precipitation of the $\sigma$ and X phases in the steel and, thus, considerably reduces the workability and ductility of the chromium steel. The amount of Mo added should not exceed 3%, preferably 2.5%, but should preferably exceed at least 0.5%.

C. Carbon of not more than 0.005% and Nitrogen of not more than 0.015%.

Since the solubility of C and N in ferritic stainless steel is quite low, and since C and N in excess of solubility precipitate as carbides, nitrides and the carbonitrides principally in the grain boundary of the steel, the ductility of the ferritic chromium steel can be damaged by this precipitation. Further, the precipitation of the precipitates is accompanied by the reduction of the Cr concentration in a proximity of each of the precipitates during this precipitation. In such a case, the Cr is reduced to a low concentration and, therefore, the corrosion resistance is damaged. The harmful influence of C and N upon the ductility and corrosion resistance, as stated above, becomes apparent, when the chromium alloyed steel is heated to an elevated temperature of 900° C. and higher followd by slow cooling, or when the chromium alloyed steel is welded. It is, therefore, desirable to reduce both C and N as low as possible, preferably below 0.004 and 0.010%, respectively, in the present invention. The maximum C content of 0.005% and the maximum N content of 0.015% are lower than those seen in the known chromium steel, mentioned previously. The maximum amount of N is higher than that of C, because N is less harmful than C.

D. At least one element selected from the group consisting of Nb and Ta is included in an amount determined by the equation:

$$20\times C(\%)\leqq Nb(\%)+0.5\times Ta(\%)\leqq 60\times C(\%).$$

It is possible, by the single or combined addition of Nb and Ta, to fix or stabilize the C and N, which are harmful to the ductility and corrosion resistance of the chromium steel, when this steel is heated to an elevated temperature followed by slow cooling or the steel is welded. The pertinent addition amounts of Nb and Ta depend on the content of C, which is particularly harmful to the ductility and the corrosion resistance. In the case of adding Nb along, the addition in an amount of from twenty to sixty times the percentage of C is the most effective. The effect of Ta can be increased to the same effect as Nb, when the content of Ta is twice as much as the content of Nb. Consequently, $0.5\times Ta(\%)$ is considered to be equivalent to Nb(%). The equation of $Nb(\%)+0.5\times Ta(\%)$ should, therefore, be used to adjust the amount of both Nb and Ta in combination, or Ta alone, into the above mentioned range of these elements.

E. O of not more than 0.008%.

When the total amount of dissolved oxygen and the combined oxygen with non metallic inclusions exceeds 0.008%, the amount of the oxides, which are not removed by the deoxidation and thus remain as impurities, is increased, with the result being that the corrosion resistance and mechanical properties are damaged.

F. Not more than 0.020% of S.

When the sulfur remains in an amount exceeding 0.020%, the corrosion resistance and mechanical properties are deteriorated.

G. Not more than 0.025% of the total of S and O.

If the total amount of S and O is more than 0.025%, the corrosion resistance and mechanical properties are damaged, as stated before.

H. From 0.0005 to 0.02% of Ca.

When the amount of Ca in the chromium steel is below 0.0005%, the deoxidation and decarburization cannot be satisfactorily performed. When the amount of Ca exceeds 0.02%, a large amount of CaO remains in the steel as a non metallic inclusion, although the deoxidation and the decarburization is satisfactorily performed. The corrosion resistance and mechanical properties are damaged by this remaining CaO.

The amount of deoxidation products present in the chromium alloyed steel should not be more than 0.02% based on the weight of the steel. The deoxidation products present in the chromium alloyed steel should be composed of from 3 to 20% of CaO, from 5 to 80% of $Al_2O_3$ and from 5 to 80% of $SiO_2$. When more than 0.02% of the deoxidation products remain in the chromium steel, the corrosion resistance and ductility are damaged. When the amount of CaO in the deoxidation products, which remain in the chromium steel, is below 3%, there is no improvement with regard to the reduction of O in the chromium steel and, also, there is no improvement in either the mechanical properties or the workability. On the other hand, even when the amount of CaO exceeds 20% the effects of the CaO are not further increased and, thus, an amount of CaO exceeding 20% has no effect from an economical point of view.

When the amount of $Al_2O_3$ in the deoxidation products, which remain in the chromium steel, is below 5%, the deoxidation of the chromium steel according to the present invention is not satisfactory, because this steel contains a large amount of chromium.

When the $Al_2O_3$, which remains in the chromium steel, according to the present invention, as one of the non metallic inclusions, is less than 5%, it is difficult to reduce the dissolved oxygen amount in the steel to a level of not more than 0.008%. On the other hand, when the amount of $Al_2O_3$ exceeds 80%, the frequency of formation of alumina clusters is hightened, with the result that the corrosion resistance and mechanical properties are damaged.

When the amount of $SiO_2$ in the deoxidation products, which remain in the chromium steel, is below 5%, these deoxidation products, which are formed by the composite non metallic inclusions, do not have a low melting point and, thus, the floating characteristic upwards through the steel melt is not good. Accordingly, when the amount of $SiO_2$ is below 5%, a low oxygen level in the chromium steel cannot be achieved. On the other hand, when the $SiO_2$ amount exceeds 80%, the formed non metallic inclusions are mainly composed of $SiO_2$ and, thus, are coarse in shape. Since it is difficult for these coarse non metallic inclusions to float upwards, the separation of the non metallic inclusions from the chromium steel is deteriorated, with the result that deoxidation becomes poor.

The other non metallic inclusions, such as $Cr_2O_3$, MnO, FeO and CaS, are present in the chromium steel according to the present invention in a minor amount, which is almost lower than the amount necessary to detect the inclusions by chemical analysis. The presence in a minor amount of the other non metallic inclusions does not essentially change the characteristic properties of the chromium steel according to the present invention.

The main advantages of the chromium alloyed steel according to the present invention are as follows.

A. An excellent corrosion resistance even when the steel is welded.

B. An excellent corrosion resistance no matter whether alkali chlorates are present or not in the caustic alkali solutions.

C. A workability during the hot working which is superior to the workability of the conventional ferritic stainless steel.

D. The machining workability is superior to that of the conventional, ferritic stainless steel.

The apparatuses for handling and producing the caustic alkaline solutions is advantageously composed by welding the parts of the chromium alloyed steel according to the present invention. It is also advantageous to employ the chromium alloyed steel according to the invention when the apparatus for handling the caustic alkaline solutions, which are produced by different processes, must fulfill one or more of the following requirements.

A. Manufacture of the apparatus by welding.

B. Stable operation of the apparatus when an external impact force is applied to the apparatus.

C. Heating a caustic alkaline solution in order to, for example, vaporize the same.

D. Handling a concentrated caustic alkaline solution of more than 15% by weight of caustic alkaline.

E. Heating a concentrated, caustic alkaline solution in order to vaporize the same.

The present invention will now be illustrated in more detail with reference to Example. In these Examples, the specimen were produced by the following procedure.

Ca-alloy was added to a molten chromium alloyed steel within a vacuum furnace, so as to refine the steel by decarburization, deoxidation and desulphurization. The molten chromium steel was then cast into a 2 kg ingot, which as forged into sheet bars having a width of 40 mm, a height of 10 mm and different lengths. These sheet bars were annealed and, then, cold-rolled to a thickness of 3 mm. The cold-rolled sheets were annealed, followed by a rapid cooling.

Specimens for an immersion test in a caustic alkaline solution were produced by cutting off the annealed, cold-rolled sheets, into pieces and having a dimension of 20 mm×30 mm×3 mm. Specimens for another immersion test, having the same dimension as the above mentioned immersion specimens, were produced by an angle butt welding of the cold-rolled and then annealed sheets. In addition to the specimens for immersion into caustic alkaline solutions, chromium alloyed steel sheets subjected to the final annealing were machined to obtain tensile-test specimens and Charpy impact-test specimens.

Cl EXAMPLE 1

Chromium alloyed steels according to the present invention, having three different compositions, as well as chromium steels having compositions which did not fall within the compositions of the present invention, were prepared. The prepared compositions are indicated in Table 2.

TABLE 2

| Specimen | | Deoxidation | Chemical analysis(%) | | | | | | | | | | | | Analysis of non metallic inclusions (%) (Relative ratio) | | |
|---|---|---|---|---|---|---|---|---|---|---|---|---|---|---|---|---|---|
| | | | Cr | Mo | C | N | Nb | Ta | O | S | Ca | Ni | Si | Mn | CaO | $Al_2O_3$ | $SiO_2$ |
| | A | Ca alloy | 30.1 | 2.07 | 0.003 | 0.008 | 0.11 | — | 0.004 | 0.015 | 0.003 | 0.20 | 0.04 | 0.05 | 0.0013 (11.5) | 0.0078 (69.0) | 0.0022 (19.5) |
| Invention | B | " | 30.5 | 2.03 | 0.003 | 0.007 | — | 0.21 | 0.004 | 0.014 | 0.003 | 0.19 | 0.03 | 0.04 | 0.0011 (12.2) | 0.0071 (78.0) | 0.000 (9.8) |
| | C | " | 29.7 | 2.00 | 0.004 | 0.008 | 0.08 | 0.13 | 0.003 | 0.016 | 0.004 | 0.21 | 0.03 | 0.02 | 0.0010 (9.7) | 0.0081 (78.5) | 0.0012 (11.8) |
| | D | Ca alloy | 27.3 | 1.95 | 0.003 | 0.007 | 0.12 | — | 0.003 | 0.016 | 0.003 | 0.20 | 0.02 | 0.04 | 0.0016 | 0.0088 | 0.0013 |
| | E | " | 25.8 | 1.02 | 0.003 | 0.007 | 0.09 | — | 0.004 | 0.014 | 0.003 | 0.19 | 0.01 | 0.03 | 0.0008 | 0.0092 | 0.0012 |
| | F | " | 35.2 | 2.15 | 0.003 | 0.008 | 0.10 | — | 0.003 | 0.014 | 0.004 | 0.21 | 0.03 | 0.03 | 0.0010 | 0.0083 | 0.0015 |
| Control | G | " | 30.2 | 2.10 | 0.003 | 0.008 | — | — | 0.004 | 0.013 | 0.003 | 0.19 | 0.02 | 0.02 | 0.0011 | 0.0079 | 0.0017 |
| | H | None | 30.8 | 1.98 | 0.004 | 0.009 | 0.11 | — | 0.015 | 0.022 | tr. | 0.21 | 0.01 | 0.02 | not analyzed | not analyzed | not analyzed |
| | I | " | 29.8 | 2.03 | 0.003 | 0.007 | — | — | 0.016 | 0.021 | tr. | 0.19* | 0.01* | 0.02* | not analyzed | not analyzed | not analyzed |

Note: elements denoted by mark "*"; mean impurities.

In the immersion test, the specimens were immersed for twenty hours in the testing reagent as shown in Table 3, which was boiled and contained in a vessel made from teflon and provided with a glass cover. The weight loss in $g/m^2$/hour of the specimens is shown in Table 3 as an average value of each two specimens.

In order to evaluate the ductility of the steels, a Charpy impact test was performed with regard to cold-rolled sheets, which were annealed at 900° C., for 10 minutes, followed by either water cooling or air cooling. Test specimens for the Charpy impact test having a 2 mm-V notch were produced from the annealed sheets, and were subjected to an impact test at a temperature of from −120° C. to −30° C.

TABLE 3

| Specimen | CORROSION TEST: Welded or not No, Composition of test reagent: 1 NaOH 50% NaCl — $NaClO_3$ — | 2 NaOH 50% NaCl 5% $NaClO_3$ — | 3 NaOH 50% NaCl 5% $NaClO_3$ 0.1% | 4 NaOH 50% NaCl 5% $NaClO_3$ 0.2% | 5 NaOH 50% NaCl 5% $NaClO_3$ 0.4% | Welding NaOH 50% NaCl 5% $NaClO_3$ 0.1% | IMPACT TEST: Water cooled DBIT (°C.) | Water cooled Impact value (kg · m/cm²) | Air cooled DBIT (°C.) | Air cooled Impact value (kg · m/cm²) |
|---|---|---|---|---|---|---|---|---|---|---|
| Invention | | | | | | | | | | |
| A | 0.025 | 0.022 | 0.026 | 0.024 | 0.023 | 0.024 | −120 | 26 | −110 | 25 |
| B | 0.020 | 0.027 | 0.023 | — | — | 0.025 | — | — | — | — |
| C | 0.021 | 0.023 | 0.020 | — | — | 0.021 | — | — | — | — |
| Control | | | | | | | | | | |
| D | 1.07 | 0.98 | 0.029 | — | — | 0.031 | — | — | — | — |
| E | 3.50 | 3.14 | 0.066 | 0.028 | 0.029 | 0.029 | — | — | — | — |
| F | 0.024 | 0.021 | 0.020 | — | — | 0.022 | — | — | — | — |
| G | — | — | 0.027 | — | — | 0.34 | −100 | 26 | −70 | 24 |
| H | — | — | 0.024 | — | — | 0.027 | −80 | 14 | −50 | 13 |
| I | — | — | 0.022 | — | — | 0.41 | — | — | — | — |

Note:
DBIT is an abbreviation of ductile-brittle transition temperature.

The relationship between the chromium content in Specimens A, B, C, D, E and F and the weight loss due to corrosion in the test reagent of 50% NaOH and 5% NaCl is illustrated in FIG. 1. A similar relationship with regard to the reagent of 50% NaOH, 5% NaCl and 0.1% $NaClO_3$ is shown in Table 3. As is clear from these relationships, the corrosion resistance is excellent at the Cr content of 29% and higher.

From a comparison of the weight loss in the horizontal row 3, of Table 3, with those in the horizontal rows 1 and 2, it will be apparent that the corrosion resistance of the control steels is extremely degraded when the small concentration of $NaClO_3$ is absent, while this degrading is prevented according to the present invention. Since the essential difference in the compositions of A, B from those of D, E and F resides in the Cr content, the prevention of the degrading mentioned above is attributable to the high Cr content according to the present invention.

From a comparison of the weight loss in the horizontal row 3, with the column of welding, it is clear that the corrosion resistance of Specimen G, which contains neither Nb or Ta, is degraded approximately thirteen times by the welding, while Specimens A, B, C, D, E and F, which contain Nb and/or Ta in an amount according to the present invention, the corrosion resistance is not degraded by the welding. It is to be noted that the addition of Nb and/or Ta is effective for preventing the corrosion resistance from being degraded due to welding when the C content is as low as 0.003%.

From a comparison of Specimen A in vertical columns 1 through 5, it is clear that the corrosion resistance is not essentially changed by the kinds of the test reagent. From a comparison of Specimens H and I, in the horizontal row 3, with the same Specimens in the column of welding, it is clear that the weight loss is increased as much as twenty times by welding when neither the Ca deoxidation and Nb addition are performed.

Further, as is clear from the impact values in Table III, the ductility (toughness) of the steel treated with Ca and containing Nb, according to the invention (A), is very superior to that of the steel only treated with Ca (G) and that of the steel only containing Nb (H). The combination of treatment by Ca with the addition of Nb is, therefore, effective to improve the ductility (toughness) of a welded steel, which is slow cooled from an elevated temperature.

EXAMPLE 2

In order to investigate influence of Ni on the chromium-alloyed steel according to the present invention, a steel of 30Cr-2Mo-1.2Ni and a steel of 30Cr-2-Mo-1.2Ni were employed as control specimens. In order to compare the corrosion resistance of chromium-alloyed steel according to the present invention with that of conventional materials, which are corrosion resistant against the caustic alkaline solutions, E-Brite 26-1 and a pure Ni were used as control specimens. The test reagents contained 50% NaOH, 5% NaCl and 0, 0.1, 0.2 or 0.4% of $NaClO_3$. The chemical compositions of the tested steel are shown in Table 4.

TABLE 4

| Specimen | Deoxidation | Chemical Analysis (%): Cr | Mo | C | N | Nb | Ta | O | S | Ca | Ni | Si | Mn |
|---|---|---|---|---|---|---|---|---|---|---|---|---|---|
| 30Cr-2Mo (Invention) | a Alloy | 30.0 | 1.86 | 0.0018 | 0.0070 | 0.13 | — | 0.004 | 0.016 | 0.003 | 0.2 | 0.18 | 0.091 |
| 30Cr-2Mo-1.2Ni (Control) | " | 29.6 | 1.91 | 0.0013 | 0.0031 | — | — | 0.004 | 0.011 | 0.004 | 1.20 | 0.07 | 0.034 |
| 30Cr-2Mo-2Ni (Control) | " | 29.9 | 2.12 | 0.0025 | 0.0059 | 0.067 | — | 0.003 | 0.015 | 0.004 | 2.35 | 0.14 | 0.027 |
| E-Brite 26-1 (Control) | No | 26.02 | 1.03 | 0.0018 | 0.009 | — | — | — | 0.012 | — | 0.10 | 0.23 | 0.02 |
| Ni (Control) | No | 0.008 | — | 0.028 | — | — | — | — | trace | — | >99 | — | 0.23 |

Figure 2:
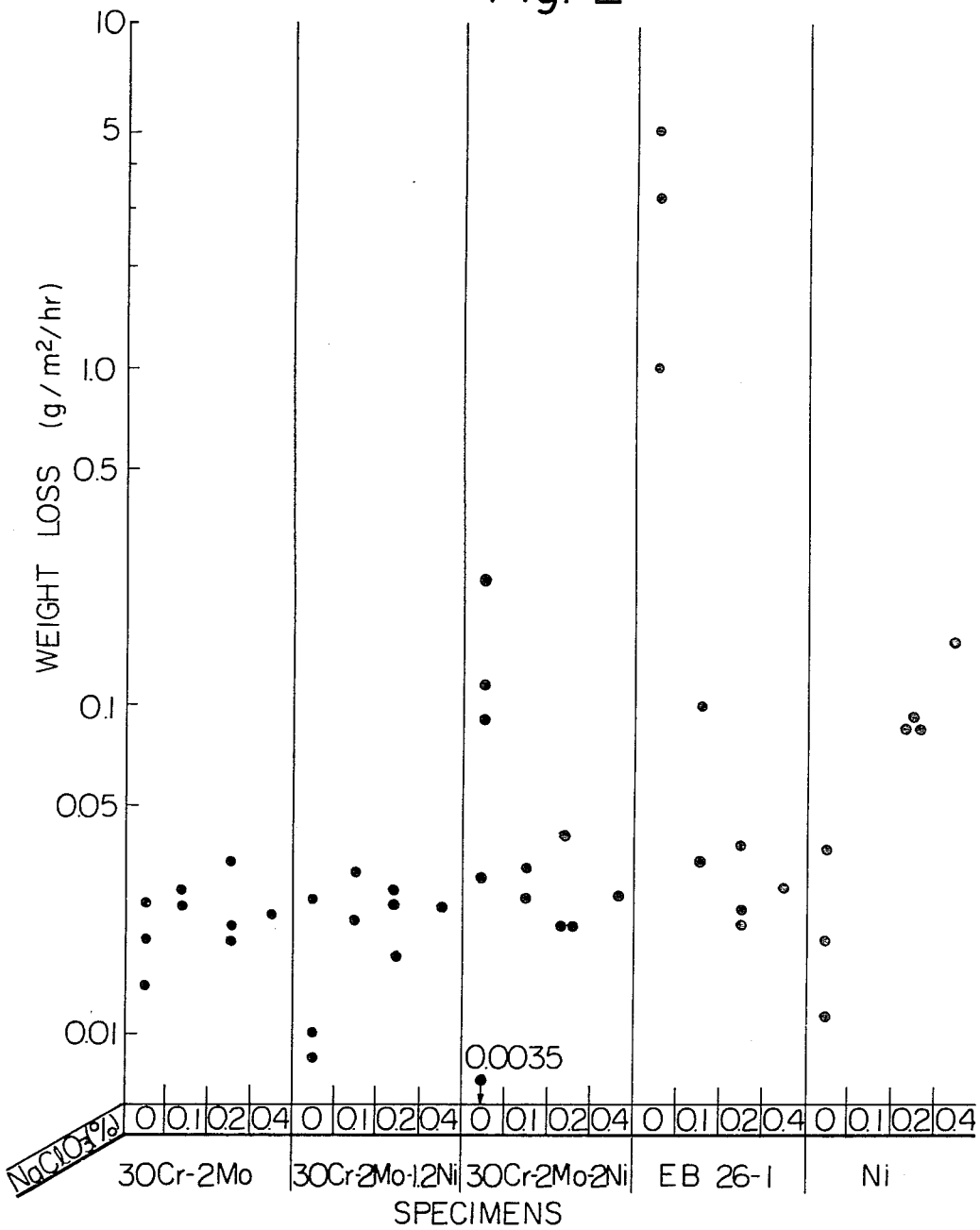

An immersion test was performed under the same conditions as in Example 1. The weight loss after the immersion test is shown in FIG. 2. The following facts will be apparent from FIG. 2.

A. Comparison of 30Cr-2Mo with 30Cr-2Mo-1.2Ni.

The addition of Ni in an amount of 1.2% does not essentially influence the corrosion resistance of the chromium steel.

B. Comparison of 30Cr-2Mo with 30Cr-2-Mo-2Ni.

Although the weight loss in the test reagent containing no $NaClO_3$ varies greatly, it is difficult to recognize from the experimental values of 30Cr-2Mo-2Ni that 2% of Ni influences the weight loss of the chromium steel according to the present invention.

C. Comparison of 30Cr-2Mo with EB26-1.

The excellent corrosion resistance of the chromium-alloyed steel according to the present invention in contrast to the EB26-1 is apparent at a concentration of $NaClO_3$ of 0.1% or when no $NaClO_3$ is present.

D. Comparison of 30Cr-2Mo with Ni.

The corrosion resistance of the chromium-alloyed steel according to the present invention is equivalent to Ni at zero concentration of $NaClO_3$ and superior to Ni at 0.2 and 0.4 concentrations of $NaClO_3$.

What we claim is:

1. A chromium alloyed steel, which is corrosion resistant to a caustic alkaline alkali chlorate solution and does not undergo any deterioration of corrosion resistance and ductility during welding and which consists essentially of, all by weight percent:

from 29 to 31% of Cr;
not more than 3% of Mo;
not more than 0.005% of C;
at least one element selected from the group of Nb and Ta in an amount, which follows the equation:

$$20\times C(\%)\leqq Nb(\%)+0.5\times Ta(\%)\leqq 60\times C(\%);$$

not more than 0.015% of N;
not more than 0.008% of O;
not more than 0.020% of S;
not more than 0.025% of the sum of S and O;
from 0.0005 to 0.02% of Ca; and
not more than 0.02% of deoxidation products being present in said chromium alloyed steel and essentially composed of:
from 3 to 20% of CaO;
from 5 to 80% of $Al_2O_3$; and
from 5 to 80% of $SiO_2$, the balance of said alloyed steel being iron.

2. A chromium alloyed steel according to claim 1, wherein said Mo is contained in an amount of not more than 2.5%.

3. A chromium alloyed steel according to claim 1, wherein Ni is contained in an amount of from minor to 2%.

4. A chromium alloyed steel according to claim 1, wherein said amount of Ni is 1.2% at the maximum.

* * * * *

UNITED STATES PATENT AND TRADEMARK OFFICE

CERTIFICATE OF CORRECTION

PATENT NO. : 4,252,561

DATED : February 24, 1981

INVENTOR(S) : HIRANO et al

It is certified that error appears in the above-identified patent and that said Letters Patent are hereby corrected as shown below:

On the title page Item /30/ should read:

-- (30) Foreign Application Priority Data

September 21, 1976 (JP) Japan 51-113,270. --

Column 7, line 11, change "X" to --x--.

Column 7, line 55, please change "along" to --alone--.

Column 10, line 22, please change "CIEXAMPLE" to --EXAMPLE--.

Column 12, line 39, (second occurrence) please change "1.2 Ni" to --2 Ni--.

Signed and Sealed this

*Seventh* Day of *September 1982*

[SEAL]

*Attest:*

GERALD J. MOSSINGHOFF

*Attesting Officer*

*Commissioner of Patents and Trademarks*